US009938952B2

(12) United States Patent
Akimoto

(10) Patent No.: US 9,938,952 B2
(45) **Date of Patent: *Apr. 10, 2018**

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/210,101

(22) Filed: Jul. 14, 2016

(65) Prior Publication Data

US 2017/0016422 A1 Jan. 19, 2017

(30) Foreign Application Priority Data

Jul. 16, 2015 (JP) ..... 2015-141853

(51) Int. Cl.
*F02P 3/05* (2006.01)
*H01F 38/12* (2006.01)
(Continued)

(52) U.S. Cl.
CPC ..... *F02P 3/055* (2013.01); *H01F 27/022* (2013.01); *H01F 27/40* (2013.01); *H01F 38/12* (2013.01)

(58) Field of Classification Search
CPC ... F02P 3/02; F02P 15/00; H01F 38/12; H01F 27/022; H01T 13/44
(Continued)

(56) References Cited

U.S. PATENT DOCUMENTS 5,419,300 A * 5/1995 Maruyama ..... F02P 3/02 123/634
7,036,495 B1 5/2006 Shimizu
(Continued)

FOREIGN PATENT DOCUMENTS

JP 2002-050528 2/2002
JP 5340889 8/2013
(Continued)

OTHER PUBLICATIONS

Akimoto, U.S. Appl. No. 15/227,191, filed Aug. 3, 2016 (29 pages).

*Primary Examiner* — John Kwon
*Assistant Examiner* — Johnny H Hoang
(74) *Attorney, Agent, or Firm* — Nixon & Vanderhye P.C.

(57) ABSTRACT

An ignition coil for internal combustion engines is provided which includes a primary and a secondary coils magnetically coupled with each other, a case, a resistor, and a resinous filler. The case includes a case body in which the primary and secondary coils are disposed and a tubular high-voltage tower extending from the case body toward a head of the ignition coil. The resistor 3 is press-fitted into the high-voltage tower and electrically connected to the secondary coil. The resinous filler is packed in the case body to hermetically seal the primary coil and the secondary coil. The resistor includes a resinous coating which covers an outer circumference of the resistor and is press-fit in the high-voltage tower through the resinous coating. This facilitates hermetically sealing a gap between the resistor body and the case and ensures the stability of the sealing.

8 Claims, 11 Drawing Sheets

(51) Int. Cl.
*F02P 3/055* (2006.01)
*H01F 27/40* (2006.01)
*H01F 27/02* (2006.01)

(58) Field of Classification Search
USPC ..... 123/143 B, 630, 632–635, 642, 650; 336/65, 107, 192, 198, 220–223
See application file for complete search history.

(56) References Cited

U.S. PATENT DOCUMENTS

| | | | | |
|---|---|---|---|---|
| 2006/0260591 | A1* | 11/2006 | Iwa | F02P 3/02 123/634 |
| 2012/0222660 | A1 | 9/2012 | Idogawa et al. | |
| 2016/0115935 | A1* | 4/2016 | Tada | F02P 3/04 315/209 T |
| 2016/0211072 | A1* | 7/2016 | Kawai | H01F 38/12 |
| 2017/0040104 | A1* | 2/2017 | Akimoto | F02P 3/02 |

FOREIGN PATENT DOCUMENTS

| | | |
|---|---|---|
| JP | 2014-022602 | 2/2014 |
| JP | 2014-022603 | 2/2014 |
| JP | 2014-022604 | 2/2014 |

* cited by examiner

IGNITION COIL FOR INTERNAL COMBUSTION ENGINE

CROSS REFERENCE TO RELATED DOCUMENT

The present application claims the benefit of priority of Japanese Patent Application No. 2015-141853 filed on Jul. 16, 2015, the entire disclosure of which is incorporated herein by reference.

BACKGROUND

1 Technical Field

This disclosure relates generally to an ignition coil for an internal combustion engine.

2 Background Art

For instance, Japanese Patent No. 5340889 discloses an ignition coil which includes a primary coil, a secondary coil, and a case. The primary and secondary coils are magnetically coupled with each other and disposed inside the case. The case is filled with resin to hermetically seal the primary and secondary coils. The case also has disposed therein a resistor which closes a front open end of the case in order to avoid leakage of the filled resin outside the case. This also results in a decrease in the number of parts of the ignition coil.

The ignition coil is so designed as to press-fit the resistor directly into the front open end of the case and, therefore, faces the drawback in that the resistor may be too large in size to be inserted into the open end of the case depending upon, for example, an error in machining the resistor or mechanical stress arising from the press-fitting of the resistor into the open end of the case may be undesirably increased, which leads to damage to or breakage of the case. Alternatively, too small a size of the resistor may result in a failure to be tightly fitted into the open end of the case, which leads to escape of the resin outside the case when the resin is packed into the case. Therefore, the ignition coil which is designed to have the resistor press-fit into the open end of the case requires high accuracy in machining the resistor and the open end of the case.

SUMMARY

It is therefore an object to provide an ignition coil for internal combustion engines which is designed to facilitate hermetically sealing a gap between a resistor and a case of the ignition coil and ensure the stability in such sealing.

According to one aspect of the disclosure, there is provided an ignition coil for an internal combustion engine which comprise: (a) a primary coil and a secondary coil which are magnetically coupled together; (b) a case which includes a case body in which the primary coil and the secondary coil are disposed and a high-voltage tower which is of a cylindrical shape and extends from the case body to a front end of the ignition coil; (c) a resistor which is fit in the high-voltage tower and electrically connected to the secondary coil; and (d) a resinous filler which is packed in the case body to hermetically seal the primary coil and the secondary coil.

The ignition coil, as described above, includes the resinous coating which covers the outer periphery of the resistor. The resistor is fit in the high-voltage tower through the resinous coating. It is, thus, easy to ensure a required dimensional relation between the inner periphery of the high-voltage tower and the outer periphery of the resistor.

Specifically, before the resistor 3 is finished, the radial dimension or diameter of the resistor is selected to be smaller than the diameter of the inner periphery of the high-voltage tower in view of a dimensional tolerance of a gap between the inner periphery of the high-voltage tower and the resistor. The periphery of the resistor is then covered with the resinous coating whose thickness is easy to control, thereby achieving a desired outer diameter of the resistor.

The resistor equipped with the resinous coating which, as apparent from the above discussion, has the highly accurate diameter is fit in the high-voltage tower, thus minimizing the degree of mechanical stress which arises from the fitting of the resistor into the high-voltage tower and acts on the high-voltage tower and also ensuring the stability of sealing between the resistor and the high-voltage tower. This obviates the risk of leakage of the resinous filler into the high-voltage tower when the resinous filter is packed in the case.

The resistor is fit in the high-voltage tower through the resinous coating, thus causing the stress acting on the resistor and the high-voltage tower to be absorbed by the resinous coating, thereby avoiding exertion of an undesirable degree of stress on the high-voltage tower. This enables the case, i.e., the ignition coil to be reduced in size without the need for increasing the thickness of the high-voltage tower to ensure a desired degree of stiffness of the case.

The structure of the ignition coil, therefore, facilitates hermetically sealing between the resistor and the case and ensures the stability of the sealing.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENT

First Embodiment

Figure 1:
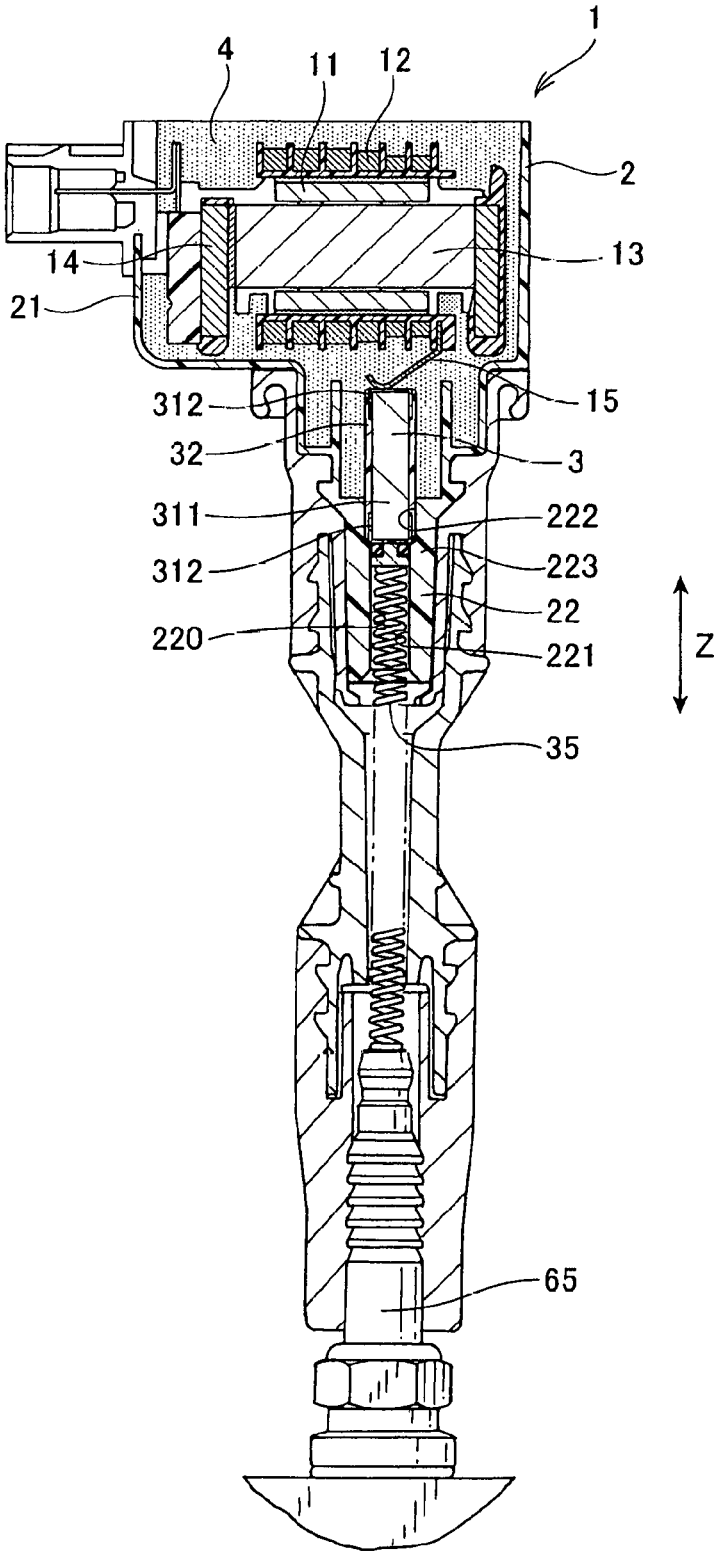
FIG. 1 is a longitudinal sectional view which illustrates an ignition coil according to the first embodiment.

Referring to the drawings, wherein like reference numbers refer to like parts in several views, particularly to FIGS. 1 to 5, there is shown an ignition coil 1 for internal combustion engine according to the first embodiment.

The ignition coil 1, as clearly illustrated in FIG. 1, includes the primary coil 11 and the secondary coil 12 which are magnetically coupled together, the case 2, the resistor 3, and the filled resin 4. The case 2 includes the case body 21 in which the primary coil 11 and the secondary coil 12 are disposed and the high-voltage tower 22 which is of a tubular shape and extends from the case body 21. The resistor 3 is tightly fit in the high-voltage tower 22 and electrically joined to the secondary coil 12. The filled resin 4 which will also be referred to as a resinous filler below is packed in the case body 21 to hermetically seal the primary coil 11 and the secondary coil 12. The resistor 3, as illustrated in FIGS. 1 to 5, has a resinous coating 32 which covers an outer periphery of the resistor 3. The resistor 3 is fit in the high-voltage tower 22 through the resinous coating 32.

In use, the ignition coil 1 is connected to the spark plug 65 mounted in an internal combustion engine for automotive vehicles or cogeneration systems and works to apply a high voltage to the spark plug 65.

In this disclosure, the high-voltage tower 22 has a given length. A direction in which the length of the high-voltage tower 22 of the case body 21 extends is referred to as the axial direction Z. The area to which the high-voltage tower 22 protrudes from the case body 21 in the axial direction Z is defined as a front end side. The area opposite the front end side in the axial direction Z is defined as a base end side or a rear end side.

The primary coil 11 and the secondary coil 12 are, as can be seen in FIG. 1, oriented to have inner and outer peripheral walls coaxially laid to overlap each other. The center core 13 is disposed inside the primary coil 11 and the secondary coil 12. The center core 13 is made of soft magnetic material. The outer core 14 is disposed outside the primary coil 11 and the secondary coil 12 and surrounds them in a direction perpendicular to the axial direction Z. The outer core 14 is made of soft magnetic material.

The primary coil 11, the secondary coil 12, the center core 13, and the outer core 14 are hermetically sealed by the filled resin 4 within the case body 21. The case 2 is made of PBT (polybutylene terephthalate) resin. The filled resin 4 is made of epoxy resin. The high-voltage tower 22 protrudes from the case body 21 toward the front end side. The high-voltage tower 22 is of a substantially hollow cylindrical shape and has a through-hole 220 extending through a length thereof in the axial direction Z.

Figure 2:
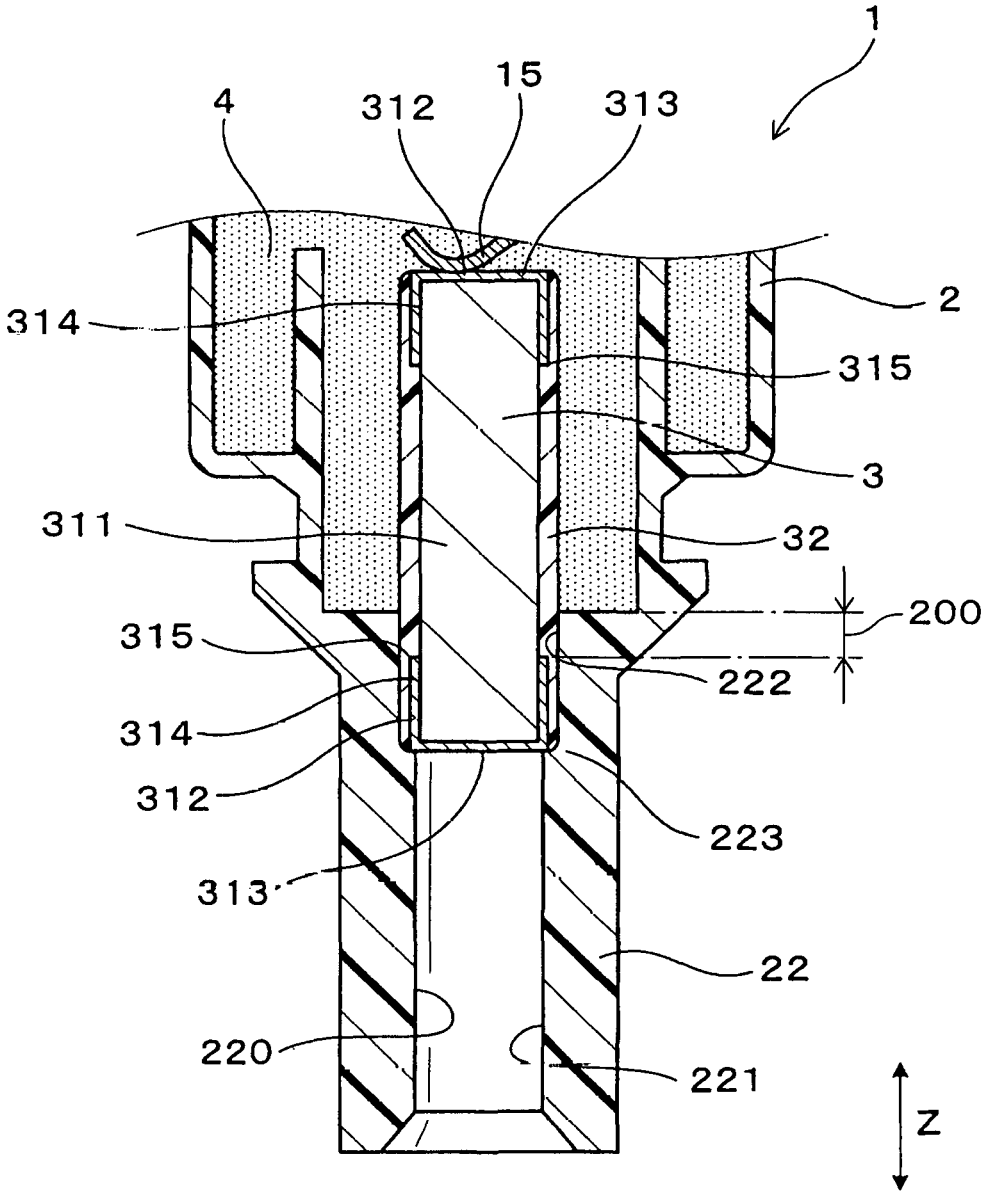
FIG. 2 is a sectional view which illustrates a region around a high-voltage tower of the ignition coil of FIG. 1.

The through-hole 220 formed in the high-voltage tower 22, as can be seen in FIGS. 1 and 2, includes portions which are arranged in the axial direction Z and different in inner diameter from each other. Specifically, the through hole 220 of the high-voltage tower 22 has a length made up of a front hole portion 221 and the rear hole portion 222. The front hole portion 221 is closer to the front end of the ignition coil 1 than the rear hole portion 222 is. The rear end hole portion 222 has an inner diameter greater than that of the front hole portion 221. The high-voltage tower 22 also includes the shoulder 223 formed between the front hole portion 221 and the rear hole portion 222 which are aligned with each other in the axial direction Z.

The resistor 3 has a given length made up of a front portion and a rear portion which is closer to the base end side of the ignition coil 1 then the front portion is. The front portion of the resistor 3 is fit in the high-voltage tower 22. The rear portion of the resistor 3 is embedded in the filled resin 4. Specifically, the front portion of the resistor 3 is fit in the rear hole portion 222 of the high-voltage tower 22. The resistor 3 has a front end surface placed in abutment with the shoulder 223 of the high-voltage tower 22 in the axial direction Z, thereby positioning or aligning it with the high-voltage tower 22.

The resistor 3, as shown in FIGS. 2 to 5, includes the resistor body 51 and a pair of electrode caps 312 fit on axially opposed ends of the resistor body 51. Each of the electrode caps 312 includes a bottom 313 and a cylindrical side wall 314. The bottom 313 covers a corresponding one of the ends of the resistor body 311. The side wall 314 extends from an edge of the bottom 313 in the axial direction Z and surrounds the outer peripheral surface of the resistor body 311. The resinous coating 32 continuously covers a circumferential surface of the resistor body 311 and the side walls 314 of the electrode caps 312. The resinous coating 32 is designed to be vertically symmetrical. In other words, the resistor 3 has a length which extends in the axial direction Z and is symmetrical with respect to a line extending radially through the middle of the length thereof. The resinous coating 32, however, may be designed to have another configuration.

The resistor body 311 is made of a ceramic cylinder which has an outer diameter constant over a length thereof in the axial direction Z. Each of the electrode caps 312 is formed by pressing a plate made of metal, such as Fe-based metal, Cu-based metal, or Al-based metal, into a cup-shape. The bottom 313 of each of the electrode caps 312 is of a disc shape. The side wall 314 extends from an edge of the bottom 313 in the axial direction Z and is of a tubular shape. The resinous coating 32 has formed on an inner peripheral wall thereof shoulders 315 on which open edges of the electrode caps 312 farther away from the bottoms 313 are seated, respectively. In other words, when the electrode caps 312 are fit on the resistor body 311, the open edge of each of the electrode caps 312 rides on a corresponding one of the shoulders 315.

Figure 3:
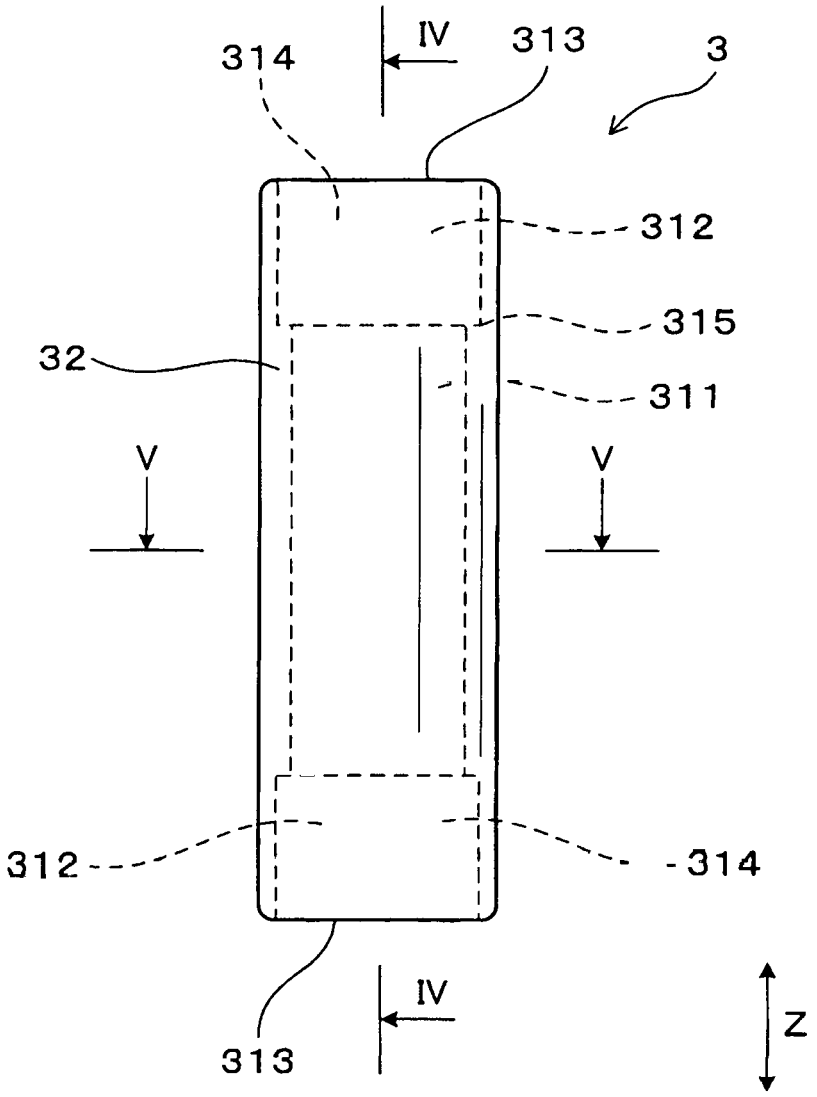
FIG. 3 is a front view of a resistor mounted in the ignition coil of FIG. 1.
Figure 4:
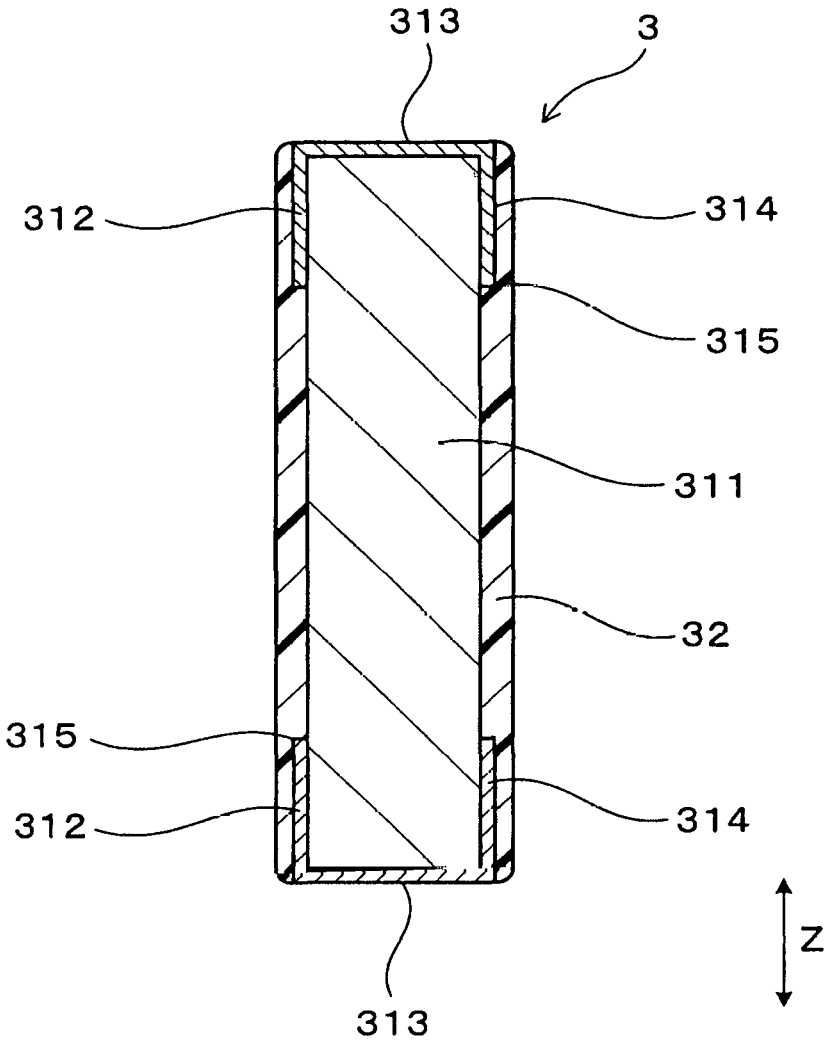
FIG. 4 is a sectional view, as taken along the line IV-IV in FIG. 3.
Figure 5:
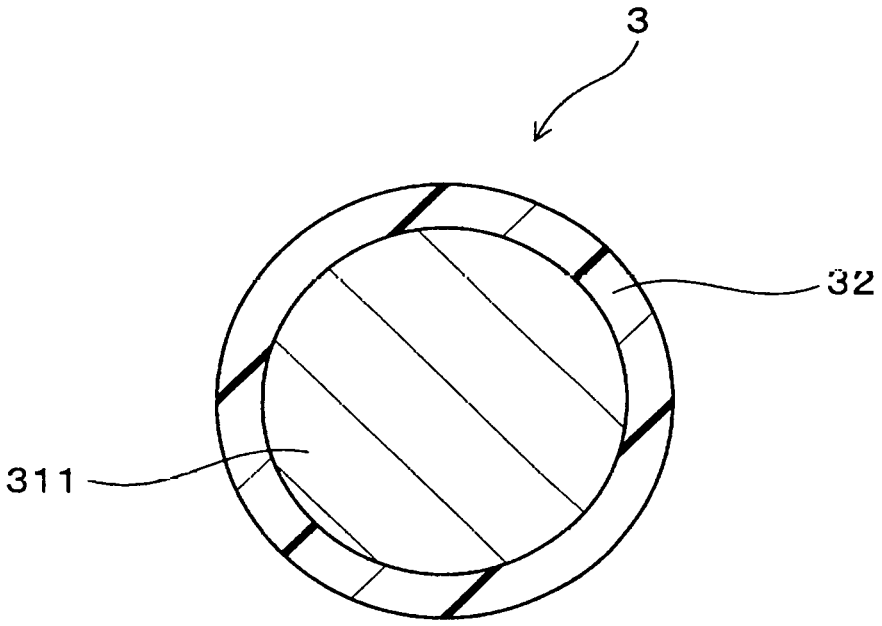
FIG. 5 is a sectional view, as taken along the line V-V in FIG. 3.

The resinous coating 32, as clearly illustrated in FIGS. 3 to 5, covers the whole of the circumferential surface of the resistor 3. In other words, the resinous coating 32 is formed over the entire circumference of the resistor 3. The resistor 3 has a surface fully covered with the resinous coating 32 except end surfaces opposed to each other in the axial direction Z. The ends of the resistor body 311 opposed to each other in the axial direction Z, that is, the bottoms 313 of the electrode caps 312 are exposed outside the resinous coating 32. The resinous coating 32 covers the open ends of the electrode caps 312 to define the shoulders 315. The resinous coating 32 is, as can be seen in FIGS. 2 to 4, formed smoothly so as to have an outer diameter kept constant over the length thereof extending in the axial direction Z. The ends of the resinous coating 32 opposed to each other in the axial direction Z each have a rounded or curved corner. The resinous coating 32 is made of PBT resin.

An assembly of the resistor body 311 on which the electrode caps 312 are fit, as illustrated in FIG. 2, has a diameter smaller than an inner diameter of the rear hole portion 222. Before impacted or press-fitted into the high-voltage tower 22, the resistor 3 including the resinous coating 32 has an outer diameter slightly greater than the inner diameter of the rear hole portion 222. The resistor 3 has a length made up of two portions: a front portion and a rear portion which is closer to the base end (i.e., the upper end, as viewed in the drawings) of the ignition coil 1 than the front portion is. The front portion is at least partially press-fit in the rear hole portion 222. The resistor 3 preferably has a portion which at least lies within a region, as indicated by numeral 200 in FIG. 2, between the open end of the front electrode cap 312 and a given distance away from it toward the base end of the resistor 3 and is press-fit in the rear hole portion 222. The resistor 3 is press-fit in the high-voltage tower 22 with an outer circumferential surface thereof, as defined by the resinous coating 32, being in contact with the inner peripheral surface of the high-voltage tower 22. In other words, the resistor 3 is tightly and closely attached to the high-voltage tower 22 through the resinous coating 32 in the radial direction of the resistor 3.

The rear portion of the resistor 3 which is not press-fit in the high-voltage tower 22 (i.e., the rear hole portion 222), as clearly illustrated in FIGS. 1 and 2, has an outer circumferential surface placed in close contact with the filled resin 4 through the resinous coating 32. In other words, the resistor 3 radially contacts the filled resin 4 through the resinous coating 32.

The electrode cap 312 fit on the base end of the resistor 3 has a surface which is exposed outside the resinous coating 32 and on which the metallic connector terminal 15 leading to the secondary coil 12 rides, thereby achieving an electric connection of the resistor 3 with the secondary coil 12. The spring 35 is disposed in contact with the front end surface of the electrode cap 312 which is exposed outside the resinous coating 32 and faces the front end side of the ignition coil 1. The spring 35 electrically connects the ignition coil 1 with the spark plug 65. Specifically, the spring 35 electrically connects the secondary coil 12 of the ignition coil 1 with the spark plug 65 through the resistor 3.

An example of how to assemble the ignition coil 1 will be described below.

First, how to produce the resistor 3 will be discussed. The electrode caps 312 are fitted on the ends of the cylindrically formed resistor body 311 from outside the ends in the axial direction Z. The assembly of the resistor body 311 on which the electrode caps 312 are fit has, as described above, a diameter slightly smaller than the inner diameter of the rear hole portion 222 of the high-voltage tower 22.

Next, the assembly of the resistor body 311 and the electrode caps 312 is put in a mold with the end surfaces thereof which are opposed to each other in the axial direction Z being tightly held. The mold has formed therein a cylindrical cavity which is shaped to have a given clearance between an inner wall of the cavity and the outer peripheral surface of the assembly. The dimensions of the cavity are selected in relation to those of the rear hole portion 222 of the high-voltage tower 22. The cavity has an outer diameter which is slightly greater than the inner diameter of the rear hole portion 222. Resin is injected into the clearance between the inner wall of the cavity and the outer peripheral surface of the assembly within the cavity to form the resinous coating 32. This completes the resistor 3, as illustrated in FIGS. 3 to 5.

Subsequently, the front portion of the resistor 3 is press-fitted into the rear hole portion 222 of the high-voltage tower 22 from outside the base end of the case 2. Specifically, the resistor 3 is impacted or press-fitted into the high-voltage tower 22 until the front portion thereof reaches the shoulder 233 in the axial direction Z, thereby positioning the resistor 3 and achieving the alignment of the resistor 3 with the case 2. This fully closes one of the open ends of the through hole 220 of the high-voltage tower 22.

Afterwards, components of the ignition coil 1, i.e., the primary coil 11, the secondary coil 12, the center core 13, and the outer core 14 are disposed in the case body 21. Resin is packed in the case body 21 from outside the base end of the case body 21 and then hardened to make the filled resin 4, thereby completing the ignition coil 1 of this embodiment.

The operation of and beneficial effects, as offered by the ignition coil 1 of this embodiment, will be described below.

The ignition coil 1 for internal combustion engines of this embodiment, as described above, includes the resinous coating 32 covering the outer periphery of the resistor 3. The resistor 3 is fit in the high-voltage tower 22 through the resinous coating 32. It is, thus, easy to ensure a required dimensional relation between the inner periphery of the high-voltage tower 22 and the outer periphery of the resistor 3. Specifically, before the resistor 3 is finished, the radial dimension or diameter of the resistor body 311 is selected to be smaller than the diameter of the inner periphery of the high-voltage tower 22 in view of a dimensional tolerance of a gap between the inner periphery of the high-voltage tower 22 and the resistor body 311. The periphery of the resistor body 311 is then covered with the resinous coating 32 whose thickness is easy to control, thereby achieving a desired outer diameter of the resistor 3.

The resistor 3, i.e., the assembly of the resistor body 311 and the resinous coating 32, as apparent from the above discussion, has the highly accurate outer diameter, thus minimizing the degree of stress which arises from the press-fitting of the resistor 3 into the rear hole portion 222 and acts on the high-voltage tower 22 and also ensuring the stability of sealing between the resistor 3 and the high-voltage tower 22. This obviates the risk of leakage of resin which has been packed in the case 2 to form the filled resin 4 into the high-voltage tower 22.

The resistor 3 is press-fit in the high-voltage tower 22 through the resinous coating 32, thus causing the stress acting on the resistor 3 and the high-voltage tower 22 to be absorbed by the resinous coating 32, thereby avoiding exertion of an undesirable degree of stress on the high-voltage tower 22. This enables the case 2, i.e., the ignition coil 1 to be reduced in size without the need for increasing the thickness of the high-voltage tower 22 to ensure a desired degree of stiffness of the case 2.

The rear portion of the resistor 3 except the front portion fit in the high-voltage tower 22 is, as described above, embedded in the filled resin 4. The outer periphery of the resistor 3 is covered with the resinous coating 32. The rear portion of the resistor 3 is, therefore, in contact with the filled resin 4 through the resinous coating 32, thus reducing the degree of stress acting on the resistor 3 and the filled resin 4.

The resinous coating 32 continuously occupies the circumferential surface of the resistor body 311 and the side walls 314 of the electrode caps 312. Specifically, the resinous coating 32 covers outer shoulders of the resistor 31, that is, the open ends of the electrode caps 312 to form the even outer circumferential surface of the resistor 3, thus avoiding the concentration of stress on an area of contact between the filled resin 4 and the resistor 3.

The structure of the ignition coil 1 of this embodiment, as apparent from the above discussion, facilitates hermetically sealing between the resistor 3 and the case 2 and ensures the stability of the sealing.

The resinous coating 32 may be replaced with a highly elastic material such as rubber in order to absorb dimensional errors of the high-voltage tower 22 and the resistor 3. The linear coefficient of expansion of the resinous coating 32 may be selected to be between those of the resistor 3 and the filled resin 4 in order to relax thermal stress exerted on the filled resin 4 and the resistor 3.

Figure 6:
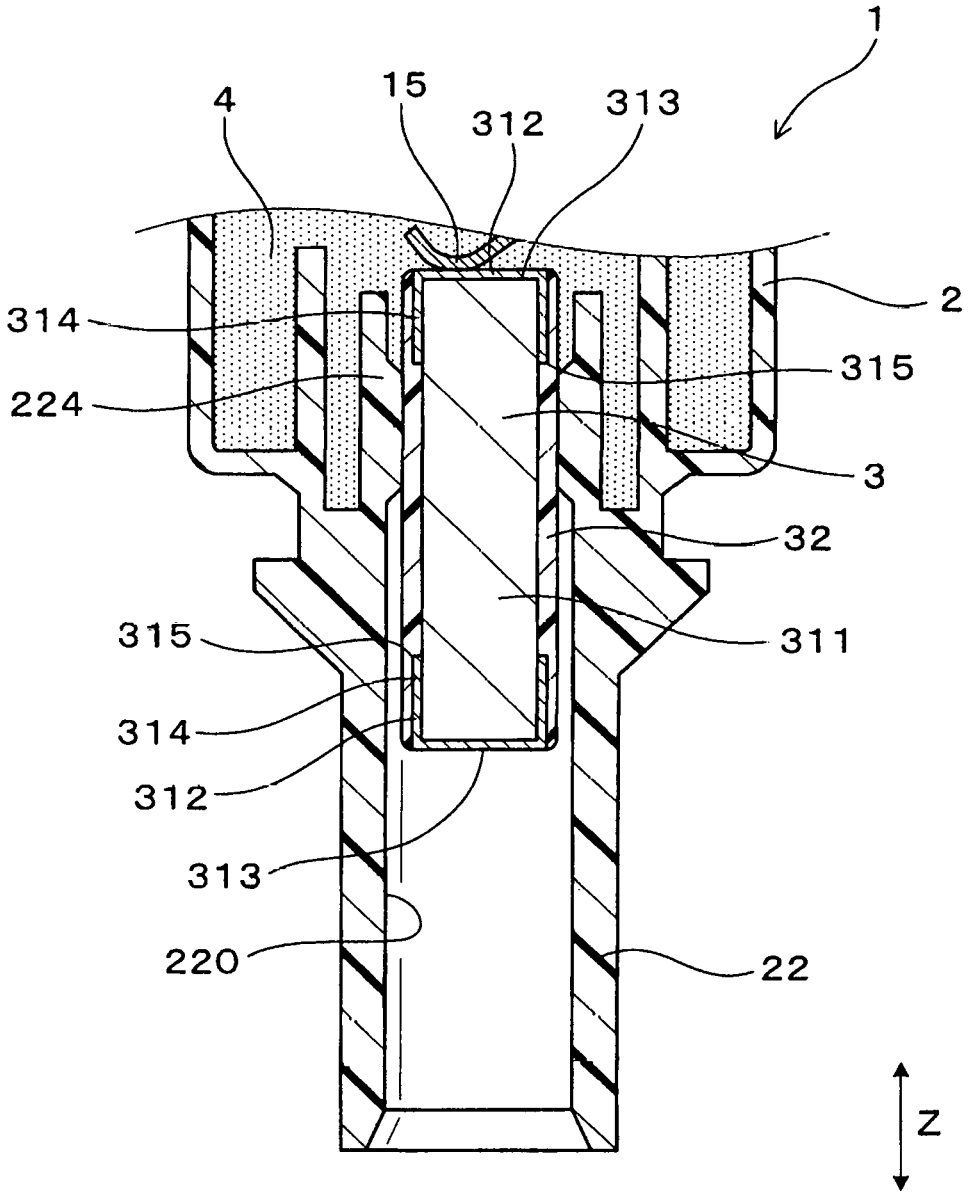
FIG. 6 is a sectional view which illustrates a modified form of an ignition coil of the first embodiment.
Figure 7:
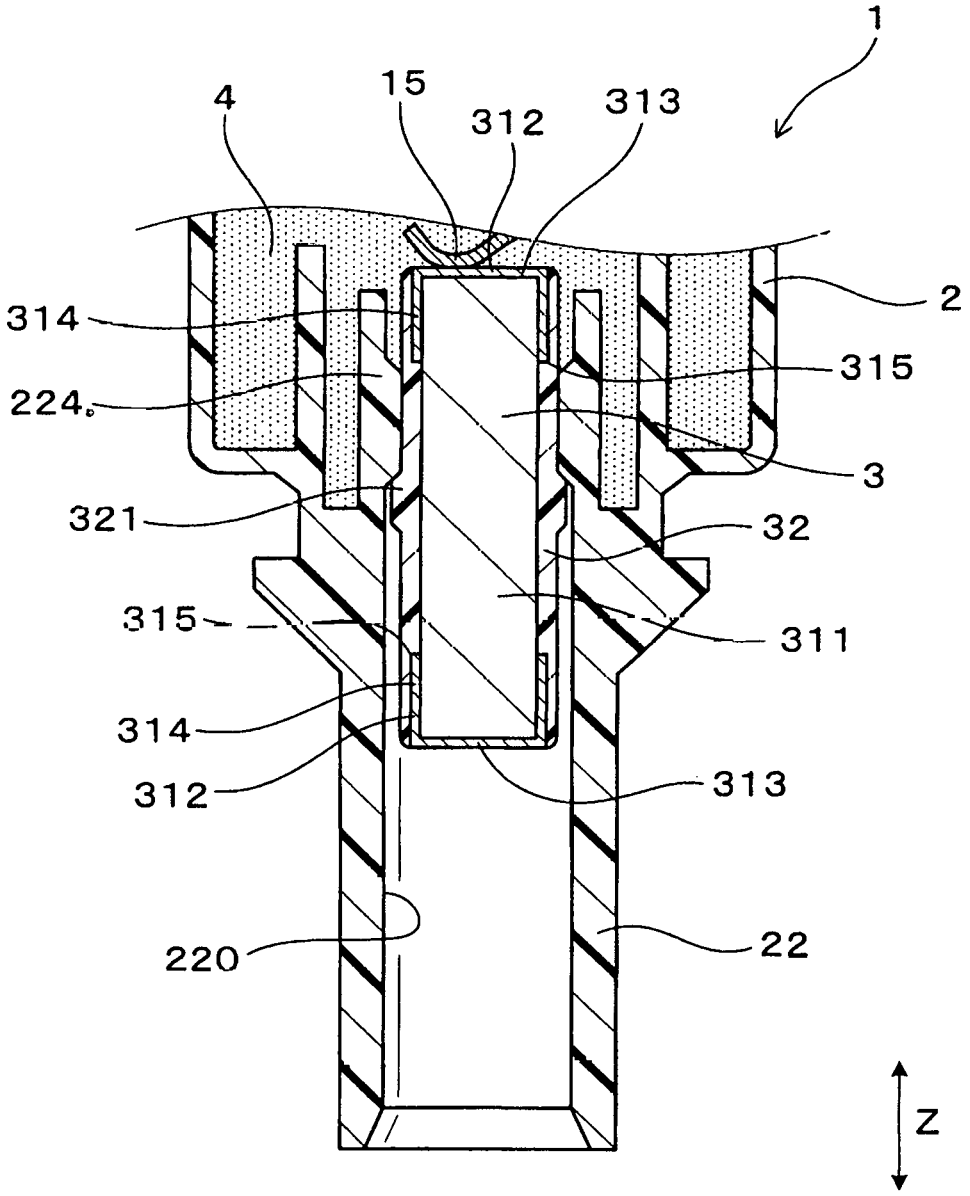
FIG. 7 is a sectional view which illustrates a second modified form of the first embodiment that is a modification of the ignition coil of FIG. 6 which includes a positioner.

The high-voltage tower 22 of this embodiment is designed to tightly retain the front portion of the resistor 3 through the press-fitting technique, but however, may alternatively be shaped to have another structure. For instance, the high-voltage tower 22 may be shaped, as shown in FIG. 6, to have formed on the inner periphery thereof an annular protrusion 224 to define a smaller-diameter bore in which the rear portion of resistor 3 is press-fit. The rear portion of the resistor 3 is, as described above, a portion of the length of the resistor 3 closer to the base end of the ignition coil 1 than the middle of the length is in the axial direction Z. FIG. 7 illustrates a modification of the ignition coil 1 in FIG. 6. The resinous coating 32 of the resistor 3 is shaped to have an annular protrusion or shoulder 321 bulging outwardly in the radial direction of the resistor body 311. The shoulder 321 rides on an end of the inner protrusion 224 of the high-voltage tower 22, thereby ensuring the alignment of the resistor 3 with the high-voltage tower 22 in the axial direction Z.

Second Embodiment

Figure 8:
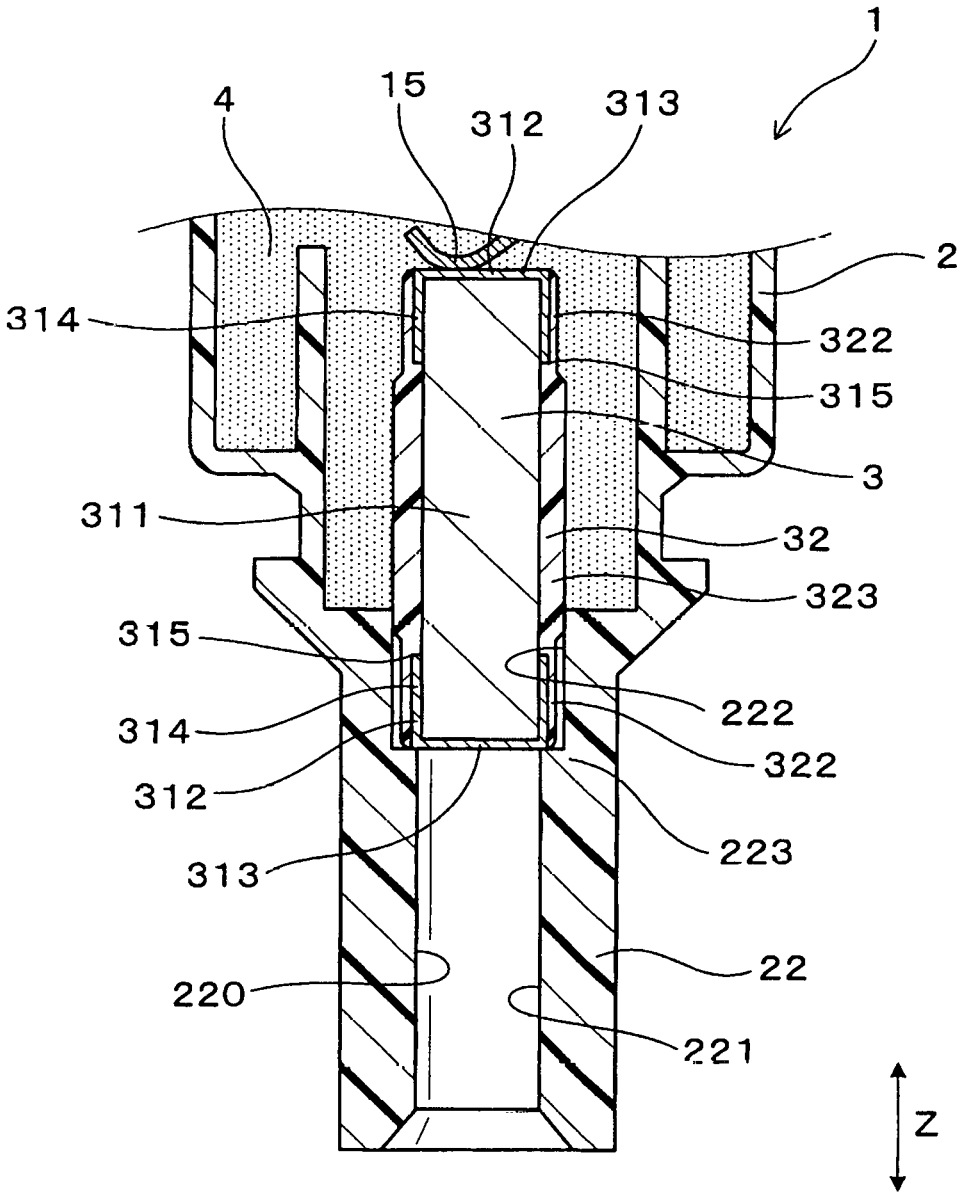
FIG. 8 is a sectional view which illustrates a region around a high-voltage tower of an ignition coil of the second embodiment.

FIG. 8 illustrates the ignition coil 1 according to the second embodiment.

The resistor 3 has a portion of the length of the resinous coating 32 which is located between the electrode caps 312 opposed to each other in the axial direction Z and which is fit in the high-voltage tower 22. In other words, the resistor 3 is press-fit at a portion thereof unoccupied by the electrode caps 312 in the high-voltage tower 22 through the resinous coating 32.

The resinous coating 32 is made up of two small-diameter portions 322 and a large-diameter portion 323 disposed between the small-diameter portions 322. The small-diameter portions 322 are opposed to each other in the axial direction Z and cover the respective electrode caps 312. The small-diameter portions 322 will also be referred to as coating end portions below. The large-diameter portion 323 bulges radially from the small-diameter portions 322. The small-diameter portions 322 and the large-diameter portions 323 cover the entire circumferential surface of the resistor body 311.

The small-diameter portions 322 have an outer diameter greater than the inner diameter of the front hole portion 221 of the high-voltage tower 22, but smaller than the inner diameter of the rear hole portion 222. The large-diameter portion 323 has an outer diameter slightly greater than the inner diameter of the rear hole portion 222 before the resistor 3 is installed in the high-voltage tower 22.

The resistor 3 is fit in the rear hole portion 222 of the high-voltage tower 22 through the large-diameter portion 323 of the resinous coating 32, so that an air gap between a front one of the small-diameter portions 322 of the resinous coating 32 and the inner peripheral wall of the rear hole portion 222 of the high-voltage tower 22.

Other arrangements are identical with those in the first embodiment. The same reference numbers, as employed in the first embodiment, refer to the same parts unless otherwise specified.

The resistor 3 is, as described above, fit at a portion of the resinous coating 32 extending the electrode caps 312 in the axial direction Z in the high-voltage tower 22. In other words, the resistor 3 is press-fit at a portion thereof unoccupied by the electrode caps 312 in the high-voltage tower 22 through the resinous coating 32. This obviates the risk of exertion of excessive stress on the resistor 3 and the high-voltage tower 22 due to a relatively great difference in linear coefficient of expansion between the resinous high-voltage tower 22 and the metallic electrode caps 312. The air gap between the front electrode cap 312 of the resistor 3 and the inner peripheral surface of the high-voltage tower 22 also serve to absorb thermal stress acting between the resistor 3 and the high-voltage tower 22.

The resistor 3 is, as already described, press-fit at a portion of the length of the resinous coating 32 between the electrode caps 312 in the high-voltage tower 22, while portions of the resinous coating 32 which are at least occupied by the electrode caps 312 are not press-fit in the high-voltage tower 22. This results in a decreased length of the resistor 3 fit in the high-voltage tower 22, thereby enabling the pressure to be reduced which is required to press-fit the resistor 3 into the high-voltage tower 22 and thus facilitating the ease of installation of the resistor 3 in the high-voltage tower 22.

The structure of the ignition coil 1 offers the same other beneficial advantages as in the first embodiment.

Third Embodiment

Figure 9:
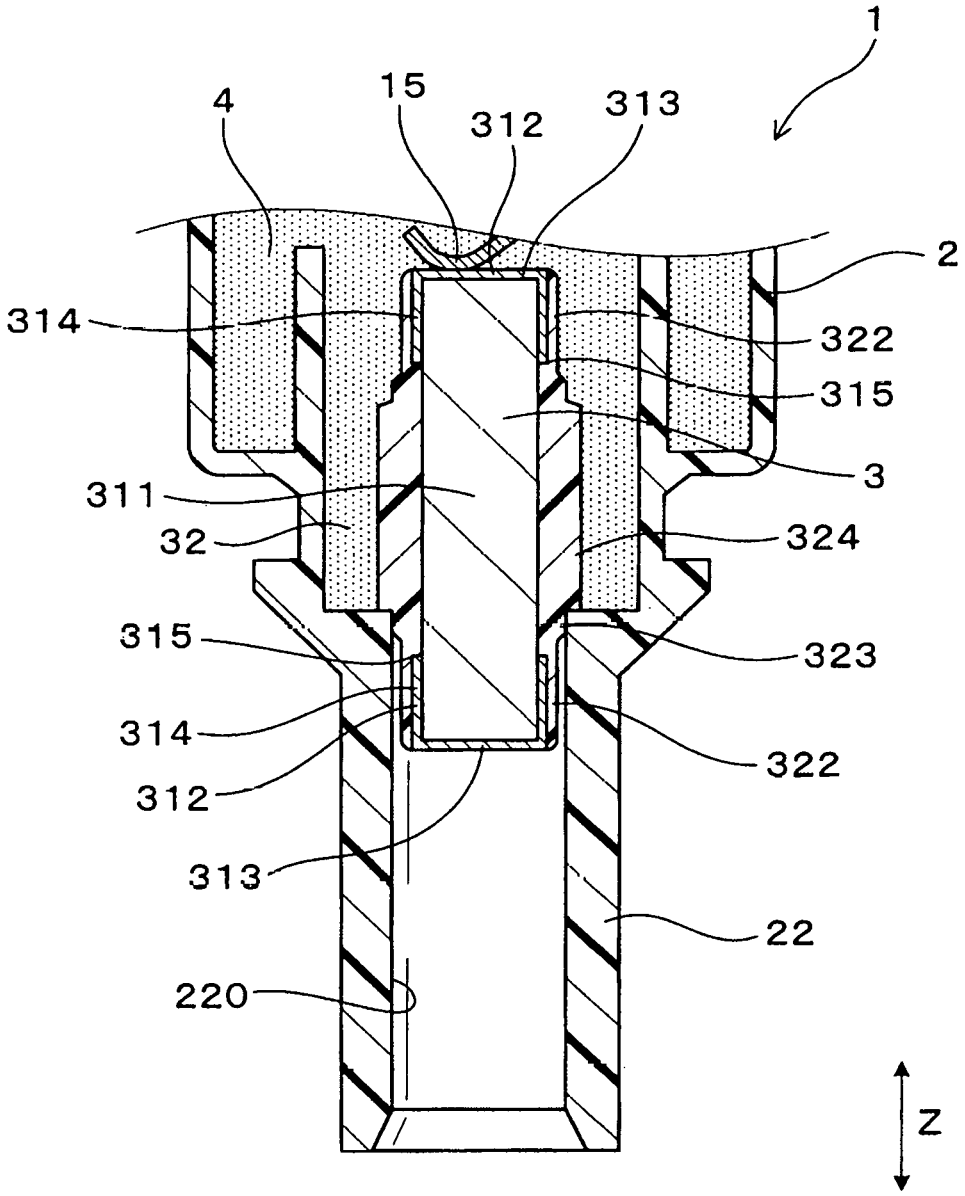
FIG. 9 is a sectional view which illustrates a region around a high-voltage tower of an ignition coil of the third embodiment.

FIG. 9 illustrates the ignition coil 1 according to the third embodiment.

The resinous coating 32 of the ignition coil 1 of this embodiment has a positioner 324 which works to position the resistor 3 relative to the high-voltage tower 22 in the axial direction Z. The through hole 220 of the high-voltage tower 22 is shaped to have an inner diameter kept constant in the axial direction Z.

The resinous coating 32, like in the second embodiment, includes two small-diameter portions 322 and the large-diameter portion 323. The resinous coating 32 also includes the cylindrical positioner 324 which bulges radially from the large-diameter portion 323. The positioner 324 is formed on a central portion of a length of the large-diameter portion 323 extending in the axial direction Z.

The large-diameter portion 323 has an outer diameter slightly greater than the inner diameter of the through hole 220 before the resistor 3 is installed in the high-voltage tower 22. The positioner 324 has an outer diameter greater than the inner diameter of the through hole 220. The resistor 3 is press-fitted into the through hole 220 in the axial direction Z until the front end of the positioner 324 (i.e., a shoulder of the resinous coating 32 which faces the front end of the high-voltage tower 22) reaches the base end of the high-voltage tower 22, thereby ensuring a selected location of the resistor 3 in the axial direction Z in the high-voltage tower 22 and also ensuring the alignment of the resistor 3 with the high-voltage tower 22 in the axial direction Z.

Other arrangements are identical with those in the second embodiment.

The ignition coil 1 of this embodiment uses the resinous coating 32 which is easy to shape as a positioner to place or hold the resistor 3 in a selected position within the high-voltage tower 22, thus facilitating the positioning of the resistor 3 without the need for a complicated structure of the high-voltage tower 22. This results in improved productivity of the ignition coil 1 for internal combustion engines.

The structure of the ignition coil 1 of this embodiment offers the same other advantages as in the second embodiment.

Fourth Embodiment

Figure 10:
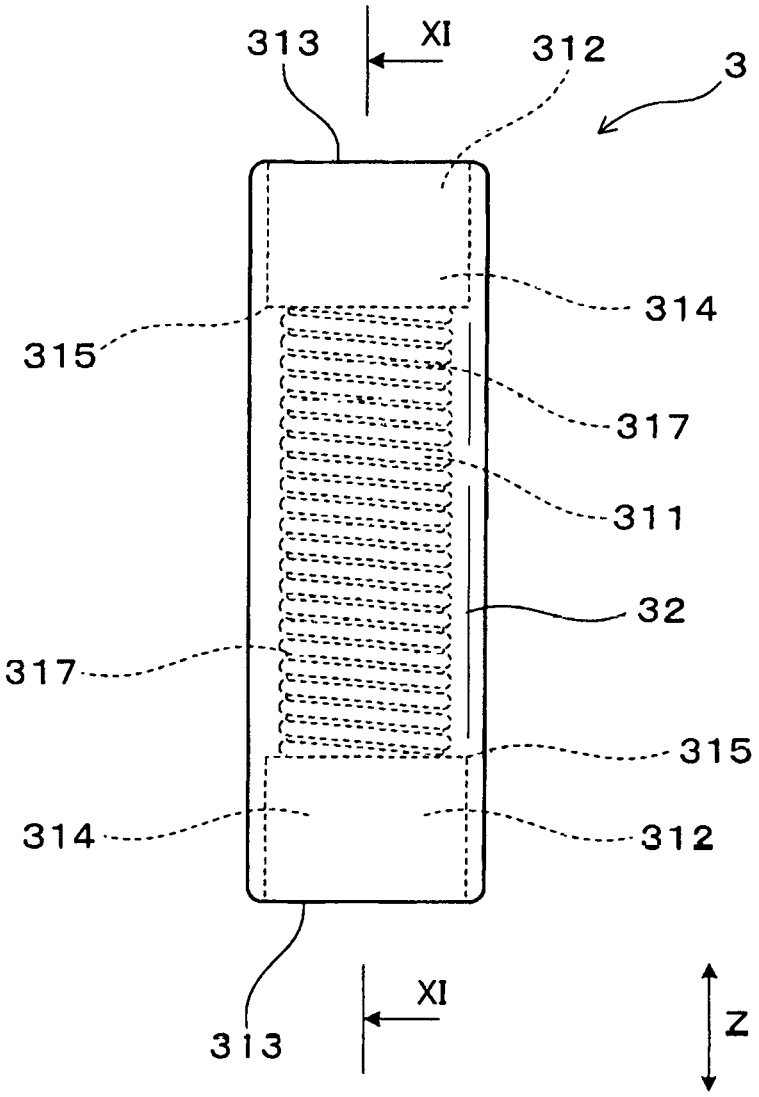
FIG. 10 is a front view which illustrates a resistor of an ignition coil according to the fourth embodiment.
Figure 11:
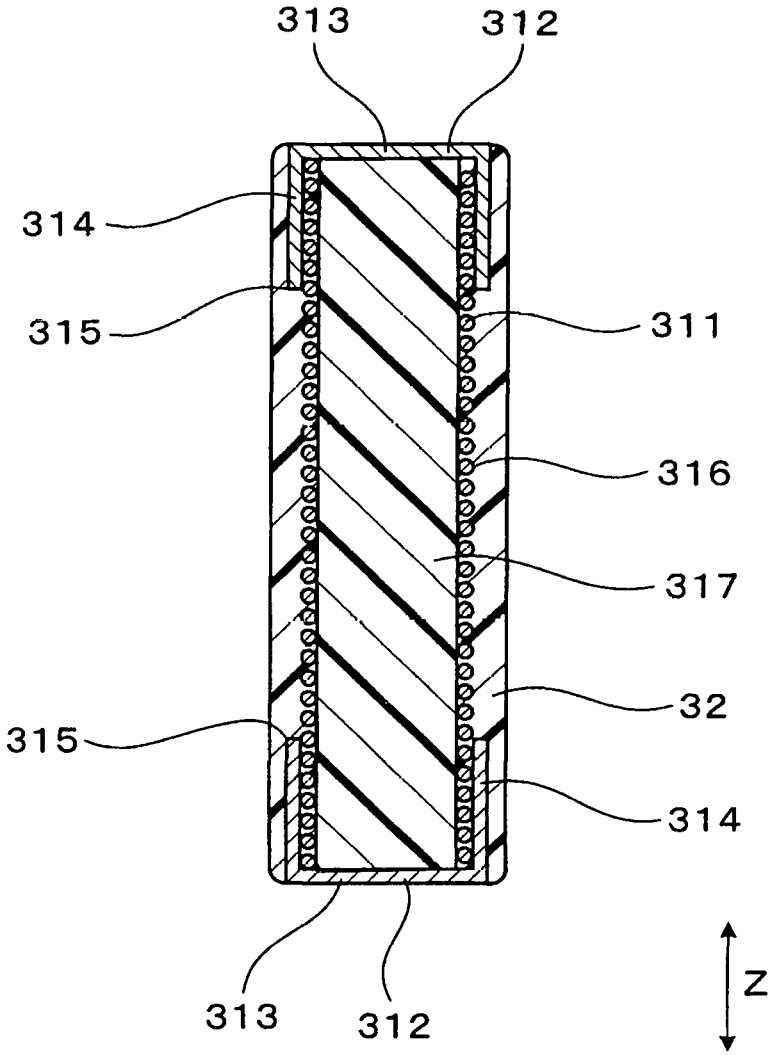
FIG. 11 is a sectional view, as taken along the line XI-XI of FIG. 10.

FIGS. 10 and 11 show the resistor 3 of the ignition coil 1 according to the fourth embodiment.

The resistor 3 has the conductive winding 316 made by winding a conductor helically. The resistor body 311 of the resistor 3 includes the electrically insulating core 317 and the conductive winding 316 wound around the core 317 in the spiral form. The resistor 3 also includes the electrode caps 312 are, like in the above embodiments, fit on the ends of the resistor body 311 which are opposed to each other in the axial direction Z through the conductive winding 316. Specifically, each of the electrode caps 312 is placed in direct contact with an outer periphery of the conductive winding 316.

The core 317 is made by, for example, impregnating a bundle of glass fiber with epoxy resin and is electrically insulating. The core 317 is substantially cylindrical and has an outer circumferential surface around which the conductive winding 316 is wound helically, thereby forming a spiral electrically conductive path. The outer circumference of the resistor 3 (i.e., the assembly of the core 317 and the conductive winding 316) is covered with the resinous coating 32.

Other arrangements are identical with those in the first embodiment.

The structure of the ignition coil 1 of this embodiment offers the same beneficial advantages as in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For instance, the resistor 3 in the above embodiments has the front portion press-fit in the high-voltage tower 22 and the rear portion embedded in the filled resin 4, but however, may have an entire length fully press-fit within the high-voltage tower 22.

What is claimed is:

1. An ignition coil for an internal combustion engine comprising:

a primary coil and a secondary coil which are magnetically coupled together;

a case which includes a case body in which the primary coil and the secondary coil are disposed and a high-voltage tower which is of a cylindrical shape and extends from the case body to a front end of the ignition coil;

a resistor which is fit in the high-voltage tower and electrically connected to the secondary coil, wherein the resistor includes a resistor body and a pair of electrode caps which are fit on ends of the resistor body which are opposed to each other in an axial direction of the high-voltage tower, each of the electrode caps including a bottom covering a corresponding one of the ends of the resistor body and a side wall which extends from an edge of the bottom in the axial direction and surrounds an outer peripheral surface of the resistor body; and a resinous filler which is packed in the case body to hermetically seal the primary coil and the secondary coil, wherein the resistor includes a resinous coating which continuously covers a circumferential surface of the resistor body and the side walls of the electrode caps to form an outer circumference of the resistor, the resistor being fit in the high-voltage tower through the resinous coating.

2. An ignition coil as set forth in claim 1, wherein the resistor includes a first portion and a second portion, the first portion being fit in the high-voltage tower, the second portion being closer to a base end of the ignition coil than the first portion is and embedded in the resinous filler.

3. An ignition coil as set forth in claim 1, wherein the resinous coating of the resistor has a portion which extends in the axial direction between the electrode caps and is fit in the high-voltage tower.

4. An ignition coil as set forth in claim 1, wherein the resinous coating has formed thereon a positioner which works to position the resistor relative to the high-voltage tower in the axial direction.

5. An ignition coil for an internal combustion engine comprising:

a primary coil and a secondary coil which are magnetically coupled together;

a case which includes a case body in which the primary coil and the secondary coil are disposed and a high-voltage tower which is of a cylindrical shape and extends from the case body to a front end of the ignition coil;

a resistor which is fit in the high-voltage tower and electrically connected to the secondary coil, wherein the resistor includes a resistor body and a pair of electrode caps which are fit on ends of the resistor body which are opposed to each other in an axial direction of the high-voltage tower, each of the electrode caps including a bottom covering a corresponding one of the ends of the resistor body and a side wall which extends from an edge of the bottom in the axial direction and surrounds an outer peripheral surface of the resistor body; and a resinous filler which is packed in the case body to hermetically seal the primary coil and the secondary coil, wherein the resistor includes a resinous coating which forms a largest outer circumference of the resistor surrounding an axial length of the resistor, the resinous coating covering a circumferential surface of the resistor body and the side walls of the electrode caps, the resistor being fit in the high-voltage tower so that the largest outer circumference contacts an inner peripheral surface of the high-voltage tower.

6. An ignition coil as set forth in claim 5, wherein the resistor includes a first portion and a second portion, the first portion being fit in the high-voltage tower, the second portion being closer to a base end of the ignition coil than the first portion is and embedded in the resinous filler.

7. An ignition coil as set forth in claim 5, wherein the resinous coating of the resistor has a portion which extends in the axial direction between the electrode caps and is fit in the high-voltage tower.

8. An ignition coil as set forth in claim 5, wherein the resinous coating has formed thereon a positioner which works to position the resistor relative to the high-voltage tower in the axial direction.

* * * * *